United States Patent [19]

Brown

[11] Patent Number: 4,471,683

[45] Date of Patent: Sep. 18, 1984

[54] VOICE COMMAND WEAPONS LAUNCHING SYSTEM

[75] Inventor: Herman E. Brown, Destin, Fla.

[73] Assignee: The United States of America as represented by the Secretary of the Air Force, Washington, D.C.

[21] Appl. No.: 411,946

[22] Filed: Aug. 26, 1982

[51] Int. Cl.[3] ..... F41H 13/00; F41G 7/26

[52] U.S. Cl. ..... 89/1 A; 244/3.13

[58] Field of Search ..... 244/3.13; 89/1 A, 1.8

[56] References Cited

U.S. PATENT DOCUMENTS

| | | | |
|---|---|---|---|
| 3,742,143 | 6/1973 | Awipi | 179/1 SA |
| 3,803,974 | 4/1974 | Everest et al. | 89/1.5 E |
| 3,880,043 | 4/1975 | Cox et al. | 89/1.5 E |
| 4,006,309 | 2/1977 | Brickerd | 179/1 VC |
| 4,215,241 | 7/1980 | Pinkney | 179/1 VC |

OTHER PUBLICATIONS

Smead, Frank W., "Voice-Actuated Avionics"; *Astronautics & Aeronautics;* Oct. 1983, pp. 55-57, 63.

"Working on Tomorrow Today . . . Voice Controlled Input Device Reduces Operator Workload", Ray Abraczinskas, Lear Seigler Instruments Log, Jun. '80.

*Primary Examiner*—Charles T. Jordan

*Attorney, Agent, or Firm*—Donald J. Singer; Jacob N. Erlich

[57] ABSTRACT

A voice-controlled weapons launching system for use by a pilot of an aircraft against a plurality of simultaneously appearing (i.e., existing) targets, such as two or more aggressor aircraft (or tanks, or the like) attacking the sole defender aircraft. The system includes, in combination, a voice controlled input device linked to and controlling a computer; apparatus (such as a television camera, receiver, and display), linked to and actuated by the computer by a voice command from the pilot, for acquiring and displaying an image of the multi-target area; a laser, linked to and actuated by the computer by a voice command from the pilot to point to (and to lock on to) any one of the plurality of targets, with the laser emitting a beam toward the designated (i.e., selected) target; and a plurality of laser beam-rider missiles, with a different missile being launched toward and attacking each different designated target by riding the laser beam to that target. Unlike the prior art, the system allows the pilot to use his hands full-time to fly and to control the aircraft, while also permitting him to launch each different missile in rapid sequence by giving a two-word spoken command after he has visually selected each target of the plurality of targets, thereby making it possible for the pilot of a single defender aircraft to prevail against the plurality of simultaneously attacking aircraft, or tanks, or the like.

9 Claims, 3 Drawing Figures

VOICE COMMAND WEAPONS LAUNCHING SYSTEM

STATEMENT OF THE GOVERNMENT INTEREST

The invention described herein may be manufactured and used by or for the Government for governmental purposes without the payment of any royalty thereon.

BACKGROUND OF THE INVENTION

This invention relates to a weapons launching system and more particularly to such a system which is controlled by voice commands.

It is well known and axiomatic in military science and tactics that if an aggressor mounts an attack with a sufficiently large force which presents to the defender more targets than the defender can counter, the aggressor almost assuredly will prevail.

A typical illustrative example of this situation, on a small scale, is when a single, defender, piloted fighter-type (or fighter-bomber type) aircraft is confronted by a plurality of simultaneous attacking weapons systems, such as a multiplicity of aggressor aircraft or tanks. In this situation it is highly unlikely that the defender aircraft will be able to attack and destroy all of the simultaneously presented aggressor targets before being destroyed itself.

Prior to the advent of the instant invention, this long-standing problem could not be overcome directly, except by participating in an arms race with the potential aggressor for numerical and/or technological superiority. Indirectly, the problem could be minimized by a defender by avoiding such a confrontation and/or by deterring the potential aggressor. Avoidance techniques have included early warning systems, whereby the aggressor's attack is detected and the defender is alerted in sufficient time to be able to adequately prepare for the aggressor's attack. Deterring approaches have included making known to the potential aggressor that the defender has credible means of destroying the aggressor in retaliation for an unprovoked attack.

SUMMARY OF THE INVENTION

The instant invention eliminates the aforesaid prior art problem. It does so directly (not indirectly) by providing a unique weapons launching system whereby the pilot of a single defender aircraft can detect, and can rapidly destroy, a plurality of simultaneously existing aggressor targets, such as the aforesaid aircraft or tanks. Succinctly, the inventive system permits the pilot of the single defender aircraft to launch a weapon toward each aggressor target, in rapid sequence, by saying two words after he has visually selected the target.

Accordingly, it is an object of the instant invention to provide a weapons launching system for an aircraft where the system is voice command controlled.

It is another object of this invention to provide high resolution imagery which will allow quick and accurate target detection, discrimination, identification, and acquisition.

It is still another object of the instant invention to permit rapid and accurate multiple target designation, thereby allowing lock-on-before-launch, assure acceptable miss distances, and also assure high kill probabilities.

It is a further object of this invention to permit quick reaction of the weapons launch system and of the user thereof, such that multiple defensive attacks on a single pass of the aircraft can be made (e.g., the sequence launching of several weapons from the system in not more than 4 or 5 seconds) while reducing the length of exposure of the aircraft to attack by the aggressors.

It is yet another object of the instant invention to minimize the pilot workload with regard to the weapons system, i.e., to keep the pilot in control of the system and of the weapons thereof, while permitting the pilot to be mostly involved in flying the aircraft.

These objects of the instant invention, as well as other objects related thereto (such as relatively low cost of the inventive system) will become readily apparent after a consideration of the description of the instant invention, together with reference to the contents of the Figures of the drawing.

DESCRIPTION OF THE PREFERRED EMBODIMENT

As a preliminary matter, it is to be noted that the terms "linked" and "operably linked" are intended to be synonymous and interchangeable, and are intended to mean operably connected, or the like, such as mechanically, or electro-mechanically, or electrically (i.e., in electrical connection, or by being responsive to an electrical signal from a source), or optically (i.e., in optical alignment), or in any other suitable, desired, necessary, or appropriate manner. It is also to be noted that the term "aboard" as in "aboard the aircraft" is used in its plural meanings, i.e., it means not only "within" but also "on" or "onto", as in "connected onto".

Figure 1:
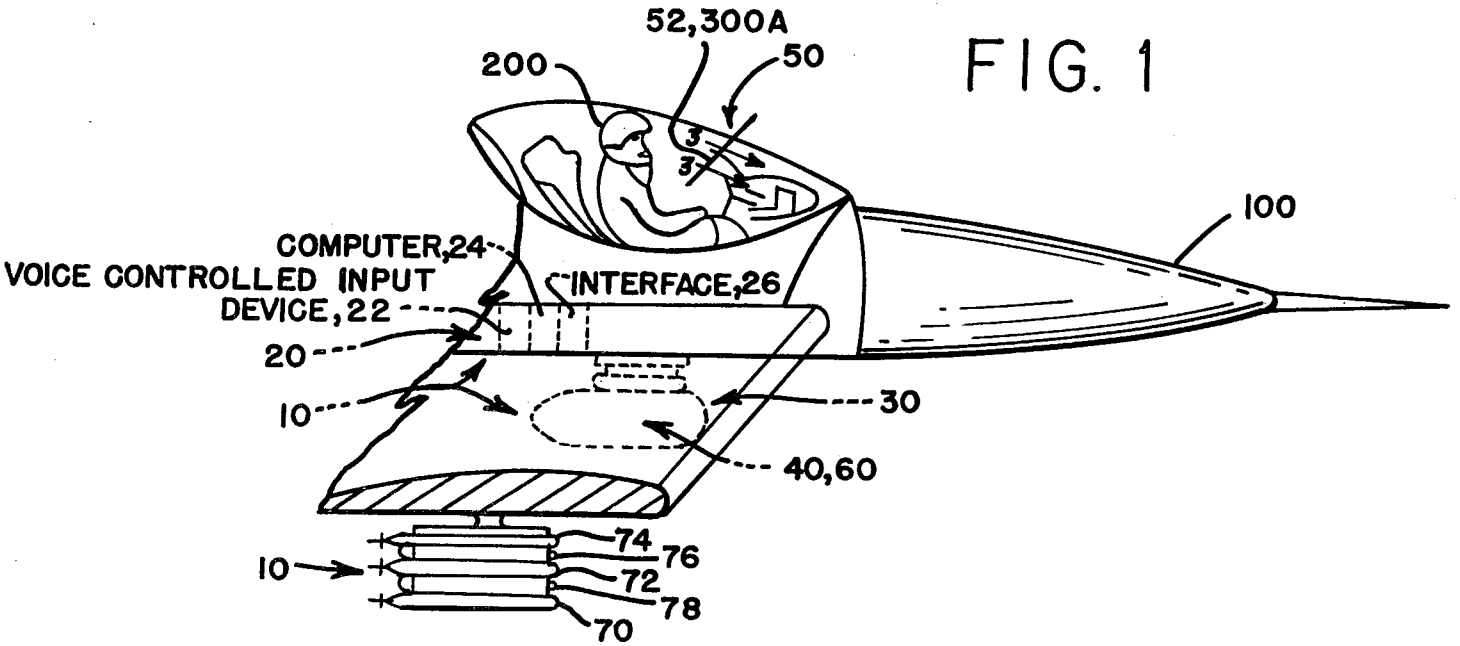
FIG. 1 is a representation of the preferred embodiment of the instant invention in simplified form, partially pictorial, partially schematic, partially in cross section, and partially fragmented.
Figure 2:
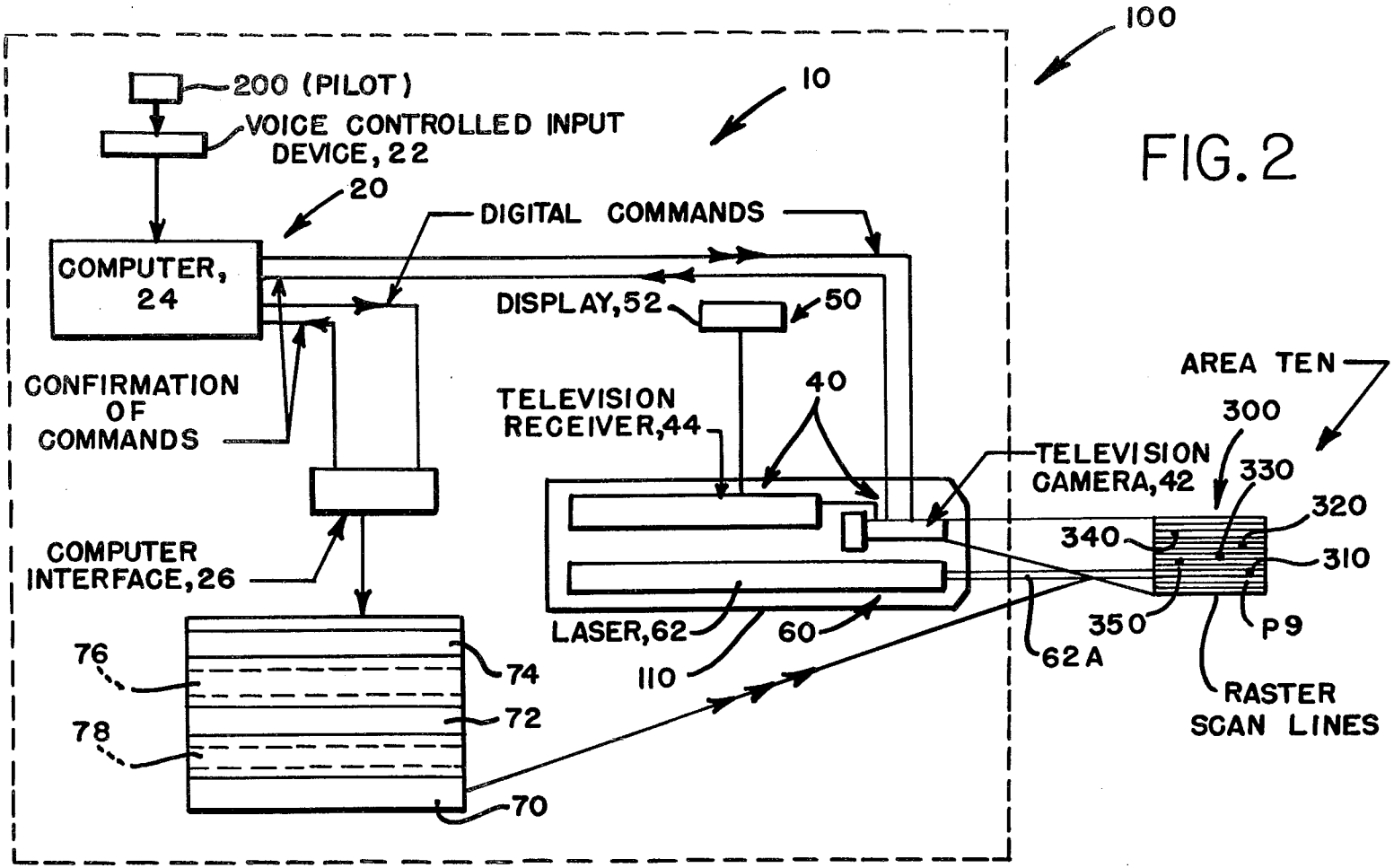
FIG. 2 is a block diagram, in flow chart form, showing how the components co-act in response to the pilot's voice command to launch a weapon from the defender aircraft toward a designated target.

Now, with reference to FIGS. 1 and 2 of the drawing, it is to be remembered that the preferred embodiment 10 of the instant invention is adapted for use by a pilot (such as is designated 200) of an aircraft (such as designated 100) against a plurality of simultaneously existing aggressor targets (such as are respectively designated 310, 320, 330, 340 and 350).

The preferred embodiment 10 of the instant invention (i.e., a voice command weapons launching system), in its most basic and generic structural form, comprises in combination: a voice controlled input means (generally designated 20) for recognizing and executing voice commands given by the pilot 200; an imaging subsystem (generally designated 30) which includes means 40 for acquiring an image of a scene 300 containing the plurality of simultaneously existing targets 310, 320, 330, 340, and 350, and means 50 for displaying the acquired image to the pilot 200; laser means (generally designated 60) for selecting any one of the acquired targets for attack as the designated target; and a plurality of laser beam-rider weapons, such as are designated respectively 70, 72, 74, 76, and 78.

More specifically, the voice controlled input means 20 is aboard the aircraft 100; is within voice range of the pilot 200; and, includes a voice controlled input device 22 and a computer 24 to which the device 22 is operably linked.

Voice controlled input devices, such as device 22, are commercially available from a number of sources, including the Instrument Division of Lear Seigler, Inc., Grand Rapids, Michigan 49508. These available devices are presently of two types, i.e., discrete word recognition type, and connected word recognition type; and, they can be speaker dependent (i.e., must recognize the voice of who is talking to be operative) or speaker independent (i.e., any voice can make the devices operative). Usually, the user of the device, such as pilot 200, wears a lightweight noise-cancelling microphone which provides electrical signals that are converted to a digital pulse code which is compared against the vocabulary reference pattern in a series of ultra-high speed computations. In a few milliseconds the result of a "match" is sent to a computer or other device to control something.

As a matter of preference, and not of limitation, the voice controlled input device 22 recognizes a plurality of spoken words, either discrete or in connected form, which include the spoken words "On", "Off", "Launch", "Area", "A", "B", "C", "D", "E", "F", "G", "H", "I", "J", "K", "L", "M", "N", "O", "P", "Q", "R", "S", "T", "U", "V", "W", "X", "Y", "Z", "One", "Two", "Three", "Four", "Five", "Six", "Seven", "Eight", "Nine", "Ten", and "Zero".

With reference to FIGS. 1 and 2 of the drawing the imaging subsystem 30 is aboard the aircraft 100; is operably linked with and is responsive to the voice controlled input means 20; and, includes means (generally designated 40) for acquiring an image 300A of a scene 300 containing the plurality of existing targets 310, 320, 330, 340 and 350; and means (generally designated 50) for displaying the acquired image 300A to the pilot 200, best seen in FIG. 2. Of course, the image displaying means 50 is operably linked to the image acquiring means 40. As a matter of preference, the display means 50 of the imaging subsystem 30 includes a display 52, FIGS. 1 and 2, with an alpha/numeric grid, such that the location of a target displayed on the grid can be vocalized by the use of two spoken words, where one word is a letter (such as "P") of the American alphabet (i.e., alphabet of the English language) and the other word is a numeral from "Zero" to "Ten", inclusive (such as "Nine").

Still with reference to FIGS. 1 and 2 of the drawing, the laser means 60 is aboard the aircraft; is operably linked with and is responsive to the voice controlled input means 20; and includes a movable laser 62 which is pointable by the pilot 200 (by use of a voice cammand) toward any one aggressor target which the pilot designates as the target to be attacked, and which emits a beam of laser light 62A toward the designated target when pointing to it. As a matter of preference, the laser 62 has the capability to scan, i.e., is movable both in azimuth and in elevation (or depression).

Preferably, and not as a matter of limitation, the image acquiring means 40 of the imaging subsystem 30, and the movable laser 62 of the laser means 60, are housed in a movable, inertially stabilized, line-of-sight pod which is attached to the aircraft 100.

Again with reference to FIGS. 1 and 2 of the drawing, the plurality of laser beam-rider weapons (such as 70, 72, 74, 76 and 78) are aboard the aircraft; and are operably linked with and are responsive to the voice controlled input means 20 by computer interface 26, such that the pilot 200 by voice command can launch one of the weapons from the aircraft 100, with the result that the launched weapon rides the emitted laser light beam 62A from the aircraft 100 to the designated target and destroys the target. Of course, each of the beam-rider weapons is launchable separately and in rapid sequence by the pilot 100 as quickly as he can give the needed voice command for each weapon. As a matter of preference, these weapons are laser beam-rider missiles.

MANNER OF OPERATION OF THE PREFERRED EMBODIMENT

Figure 3:
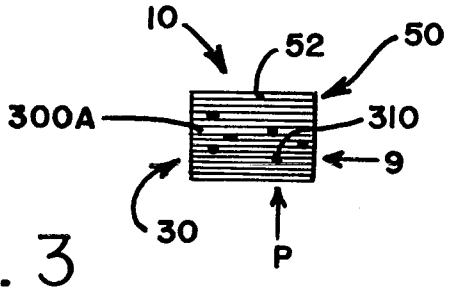
FIG. 3 is the view of a cockpit display with an alpha/numeric grid as seen by the pilot along line 3—3 of FIG. 1.

The manner of operation, and of use, of the preferred embodiment 10, FIGS. 1–3, of the instant invention can be easily ascertained by any person of ordinary skill in the art from the foregoing description, coupled with reference to the contents of the Figures of the drawing.

For others, the following explanation is given for illustrative purposes, assuming that pilot 200, FIGS. 1 and 2, of defender aircraft 100, FIGS. 1 and 2, is confronted by a plurality of aggressor aircraft, such as 310, 320, 330, 340, and 350, FIG. 2.

When the pilot 200 sees the aggressor aircraft 310, 320, 330, 340, and 350, he speaks the command word "On", and the system is turned on by the computer 24, FIGS. 1 and 2, which receives the command from the voice controlled input device 22, FIGS. 1 and 2. Then, the voice directs the pod 110, and of course thereby directs the line-of-sight of the pod, to the area (FIG. 2) of the aggressor aircraft by the appropriate voice command (such as the two spoken words "Area Ten"). As a result, the image acquiring means 40 (which can comprise a television camera 42, FIG. 2, linked to a television receiver 44 FIG. 2) acquires the image 300A, FIGS. 1 and 3, of scene 300, FIG. 2, which contains and depicts the aggressor aircraft on the alpha/numeric grid of the pilot's display screen 52, FIGS. 1–3, and thereby, their location, in accordance with the grid coordinates of the display 52. Next, the pilot 200 vocalizes a two-word grid coordinate location of each of the aggressor aircraft/targets (such as 310) to be attacked, such as "P Nine". The two-word voice commands are given separately and in sequence by the pilot 200 who, it is realistically estimated, could read aloud the location of each sequential target at the rate of about one per second. Accordingly, he could voice command the two-word grid location of each of the five (5) representative aggressor aircraft/targets to the voice controlled input device 22 (and, thereby, to the computer 24) in five (5) seconds. After each one of the five two-word spoken commands is given by the pilot 200, the computer 24, through suitable conventional linkage, causes: the laser 62, FIG. 2, to point to the target located at the pilot-identified grid coordinates and to emit a beam of laser light 62A, FIG. 2, toward the designed target (such as 310, FIGS. 2 and 3); and, one beam-rider weapon (such as beam-rider missile 70, FIGS 1 and 2) to be launched from the weapons system 10. The launched beam-rider missile 70 rides the emitted laser light beam 62A from the aircraft pod 110, FIGS. 1 and 2, to the designated target 310, hits that target, and destroys it. Thus, in rapid due course, the outnumbered defender aircraft 100 will have destroyed, and will have prevailed over, the plurality of aggressor aircraft 310, 320, 330, 340 and 350. Then, the weapons system 10 can be shut down by the pilot's voice command, "Off".

It is here to be noted: that the response of the weapons system 10 is limited only by the speed of the eyes and voice of the pilot 200; and, that the pilot's hand are not involved in the operation or in the use of the weapons system 10, so that the pilot 100 can use them to fly and control the aircraft 100 on a full-time basis.

CONCLUSION

It is abundantly clear from all of the foregoing, and from the contents of the Figures of the drawing, that the stated objects of the instant invention 10, as well as other objects related thereto, have been achieved.

It is to be noted that, although there have been described and shown the fundamental and unique features of the instant invention, as applied to a preferred embodiment 10, nevertheless various other embodiments, variations, adaptations, substitutions, additions, and the like may occur to and can be made by those of ordinary skill in the art. For example: (a) the weapons system 10 can be adapted for use on an elevated platform (such as an outpost tower guarding a defender's land base against a plurality of simultaneously attacking tanks, or the like; or (b) the weapon system 10 can be modified or varied such that, after the pilot has voice-commanded the system to the "on" mode and after he has voice-directed the display 52 to show (and the pod 110 to point to) the appropriate multi-target area, the laser 62 can be voice-commanded to scan the target area in raster scan line fashion (FIG. 2) to point to and lock-on to each target, in sequence, that it identifies and acquires in the pilot-selected multi-target area.

What is claimed is:

1. A voice command weapons launching system for use by a pilot of an aircraft against a plurality of simultaneously existing targets, comprising:

a. a voice controlled input means, aboard said aircraft within voice range of the pilot, for recognizing and executing voice commands given by said pilot, wherein this means includes a voice controlled input device and a computer to which said device is operably linked;

b. an imaging subsystem aboard said aircraft and operably linked with and responsive to said voice controlled input means, wherein said subsystem includes:

means for acquiring an image of a scene containing a plurality of simultaneously existing targets; and means for displaying said acquired image to said pilot, with this means operably linked to said image acquiring means;

c. a laser means, aboard said aircraft and operably linked with and responsive to said voice controlled input means, for selecting any one target of said plurality of simultaneously existing targets as the target designated for attack by emitting a beam of laser light toward said designated target in response to voice commands given by said pilot, wherein this means includes a movable laser member which is pointable toward said designated target; and d. a plurality of laser beam-rider weapons, aboard said aircraft and operably linked with and responsive to said voice controlled input means, whereby one weapon of said plurality is individually and separately launched from said aircraft in response to voice commands given by said pilot, and whereby said launched weapon rides said emitted laser light beam from said aircraft to said designated target; and whereby, in rapid sequence and in response to voice commands given by said pilot, each target of said plurality of simultaneously existing targets is sequentially designated as the target to be attacked and is attacked by the launching of a different one of said plurality of laser beam-rider weapons toward said designated target.

2. A voice command weapons launching system, as set forth in claim 1, wherein said voice controlled input device is speaker dependent.

3. A voice command weapons launching system, as set forth in claim 1, wherein said voice controlled input device is speaker independent.

4. A voice command weapons launching system, as set forth in claim 1, wherein said voice controlled input device recognizes a plurality of spoken words which include the spoken words "On", "Off", "Launch", "Area", "A", "B", "C", "D", "E", "F", "G", "H", "I", "J", "K", "L", "M", N", "O", "P", "Q", "R", "S", "T", "U", "V", "W", "X", "Y", "Z", "One", "Two", "Three", "Four", "Five", "Six", "Seven", "Eight", "Nine", "Ten", and "Zero".

5. A voice command weapons launching system, as set forth in claim 1, wherein said display means of said imaging subsystem includes a display with an alpha/numeric grid, whereby the location of a target displayed on said grid can be vocalized by the use of two spoken words, where one word is a letter of the alphabet of the English language and the other word is a numeral from "Zero" to "Ten", inclusive.

6. A voice command weapons launching system, as set forth in claim 1, wherein said laser member of said laser means is useable in a scanning manner.

7. A voice command weapons launching system, as set forth in claim 1, wherein said laser beam-rider weapons are laser beam-rider missiles.

8. A voice command weapons launching system, as set forth in claim 1, wherein said image acquiring means of said imaging subsystem, and said movable laser member of said laser means, are housed in a movable, inertially stabilized, line-of-sight pod attached to said aircraft.

9. A voice command weapons launching system, in combination with an aircraft, for use by the pilot of said aircraft against a plurality of simultaneously existing targets, wherein said weapons launching system comprises:

a. a voice controlled input means, aboard said aircraft within voice range of the pilot, for recognizing and executing voice commands given by said pilot, wherein this means includes a voice controlled input device and a computer to which said device is operably linked;

b. an imaging subsystem aboard said aircraft and operably linked with and responsive to said voice controlled input means, wherein said subsystem includes:

means for acquiring an image of a scene containing a plurality of simultaneously existing targets; and means for displaying said acquired image to said pilot, with this means operably linked to said image acquiring means;

c. a laser means, aboard said aircraft and operably linked with and responsive to said voice controlled input means, for selecting any one target of said plurality of simultaneously existing targets as the target designated for attack by emitting a beam of laser light toward said designated target in response to voice commands given by said pilot, wherein this means includes a movable laser member which is pointable toward said designated target; and d. a plurality of laser beam-rider weapons, aboard said aircraft and operably linked with and responsive to said voice controlled input means, whereby one weapon of said plurality is individually and separately launched from said aircraft in response to voice commands given by said pilot, and whereby said launched weapon rides said emitted laser light beam from said aircraft to said designated target; and whereby, in rapid sequence and in response to voice commands given by said pilot, each target of said plurality of simultaneously existing targets is sequentially designated as the target to be attacked and is attacked by the launching of a different one of said plurality of laser beam-rider weapons toward said designated target.

* * * * *